United States Patent [19]

Yamamori et al.

[11] 4,364,065

[45] Dec. 14, 1982

[54] INK JET WRITING APPARATUS HAVING A NOZZLE MOISTENING DEVICE

[75] Inventors: Kiyoshi Yamamori, Kanagawa; Yasutaka Hiromori, Sagamihara; Akira Mizoguchi, Hirakata, all of Japan

[73] Assignee: Matsushita Electric Industrial Company, Limited, Osaka, Japan

[21] Appl. No.: 177,372

[22] Filed: Aug. 12, 1980

[30] Foreign Application Priority Data

Aug. 13, 1979 [JP] Japan ..... 54-111500[U]

[51] Int. Cl.[3] ..... B41J 3/04; G01D 15/18

[52] U.S. Cl. ..... 346/140 R

[58] Field of Search ..... 346/75, 140 R, 140 A; 239/39-42; 15/245

[56] References Cited

U.S. PATENT DOCUMENTS

| | | | |
|---|---|---|---|
| 218,431 | 8/1879 | Dunham | 15/245 |
| 2,687,916 | 8/1954 | Reynolds | 239/41 |
| 4,223,324 | 9/1980 | Yamamori et al. | 346/140 R |

FOREIGN PATENT DOCUMENTS

| | | | |
|---|---|---|---|
| 2607313 | 9/1977 | Fed. Rep. of Germany | 346/140 R |
| 54-119238 | 9/1979 | Japan | 346/140 R |

*Primary Examiner*—John Gonzales

*Attorney, Agent, or Firm*—Lowe, King, Price & Becker

[57] ABSTRACT

In order to prevent clogging of the nozzle of an ink jet writing head, a nozzle moistening device is provided which includes an elastic enclosure fluid-tightly engageable with the front face of the writing head when not in use, a source of water, and a capillary tube for transmitting water from the source to the enclosure by capillary action to permit evaporation of water in the enclosure to moisten the nozzle.

12 Claims, 6 Drawing Figures

INK JET WRITING APPARATUS HAVING A NOZZLE MOISTENING DEVICE

BACKGROUND OF THE INVENTION

The present invention relates to an ink jet writing apparatus, and in particular to an ink jet writing apparatus having means for preventing the clogging of ink when the writing head is not in operation.

Ink jet printing has been known in the art as exemplified by the system shown and described in U.S. Pat. No. 4,106,032. In the system described in this patent, a jet of writing fluid or ink is caused to issue from a nozzle in the form of a succession of tiny individual droplets of a varying size depending on the instantaneous value of an input signal which is to be recorded. The nozzle is moved across the surface of a recording medium so that the ink droplets are ejected to desired print positions.

In a writing system of the type described above, nozzle clogging has presented a well known problem. One of the reasons of clogging is due to the ink drying in the nozzle over a standstill period. The nozzle has an inside diameter in the order of 40 micrometers and ink allowed to stay therein tends to clog the opening when the ink has dried. Prior attempts have been made to solve this problem. For example, United States patent application No. 20,977 filed Mar. 16, 1979, now U.S. Pat. No. 4,223,324, discloses a system in which a solenoid-operated rubber-coated pad is brought up to close the nozzle opening to prevent the ink from drying when the system is not in use. In the disclosed system, moisture laden air is forced through a space between the pad and the nozzle opening when the system is at standstill to moisten the nozzle opening.

However, this system is still not satisfactory for a number of reasons. Firstly, since the contacting surface of the rubber-coated pad and the front face of the writing head on which the nozzle opening is provided are not strictly parallel to each other due to manufacturing errors, it is difficult to provide a fluid-tight chamber that encloses the nozzle opening, so that moisture laden air tends to escape through a space between the misaligned surfaces. Secondly, since the moisture laden air is supplied from a pressurized air source, it is necessary to keep the compressor operating even if the system is left unattended for a long period of time, which is undesirable from the power savings standpoint.

One approach to these problems would be to submerge the nozzle into water when the system is not in operation. However, the water tends to introduce into the nozzle and the ink in the nozzle would be excessively diluted with the result that upon resumption of the writing operation the initial printing is unsatisfactory.

SUMMARY OF THE INVENTION

According to the present invention, the ink jet writing apparatus comprises an ink jet writing head having a nozzle from which ink issues, an elastic enclosure engageable with a front face of the writing head to define a fluid-tight chamber enclosing the opening of the nozzle, a source of ink diluting fluid, a tubular member connected between the fluid source and the elastic enclosure including a capillary member therein for transmitting the fluid from the source to the enclosure by capillary action to permit evaporation of the fluid in the chamber, and means for producing a sealing contact between the writing head and the enclosure to create said fluid-tight chamber when the writing head is not in operation.

The use of the capillary tube provides advantages in that it allows a design flexibility whereby the source of ink diluting fluid or water can be located at any desired position and a plurality of such capillary tubes can be provided for a multiple-head writing system using a single source of water.

Preferably, a heating device is provided for heating a portion of the capillary tube to increase the rate of evaporation of water at the end of the tube.

Maintenance effort can be minimized by the use of a water-containing cartridge which is detachably mounted on the water source for refilling it when the water therein has been consumed. The cartridge includes a spring-loaded valve member which normally engages a valve seat when the cartridge is separated from the water source. Upon mounting on the water source, the valve member is automatically disengaged from contact with the valve seat allowing the water in the cartridge to be admitted into the lower chamber until the head of the water therein becomes flush with the opening of the nozzle. When the water in the lower chamber has been consumed so that its head becomes lower than the nozzle opening air is introduced into the upper chamber to allow the water therein to be admitted into the lower chamber until it is filled to the level of the nozzle opening of the upper chamber. Since the head of the water in the lower chamber or water supply source is maintained at a constant level, the rate of evaporation at the end of the capillary tube can also be maintained constant at all times. Since the vapor is confined within the fluid-tight chamber, the amount of water consumption is minimized so that the water supply source can be left unattended for a long period of time.

When the writing head is operated in response to an input signal having an amplitude close to the operating threshold level of the head which is also a function of the physical properties of the ink being used, the ink in the nozzle tends to spray around the nozzle opening as it emerges therefrom and accumulate therearound. This accumulated ink will then be dried and during this drying process it might collect dust and fine particles floating in the air and eventually becomes a thick layer of mixture of residual ink and such substances, or sludge. When this layer is exposed to the moisture produced by the capillary tube, it absorbs it and returns to the original state and is likely to narrow the nozzle opening, or produce stains on a writing surface, or could lead to an electrical circuit failure because of the conductive nature of the sludge.

This problem can be solved by the provision of a cleaning device mounted stationary with respect to the writing head for making a wiping contact with the front face of the writing head as the latter is moved between non-printing and printing positions to scrape off the sludge.

BRIEF DESCRIPTION OF THE DRAWINGS

The present invention will be further described by way of example with reference to the accompanying drawings, in which.

DETAILED DESCRIPTION

Figure 1:
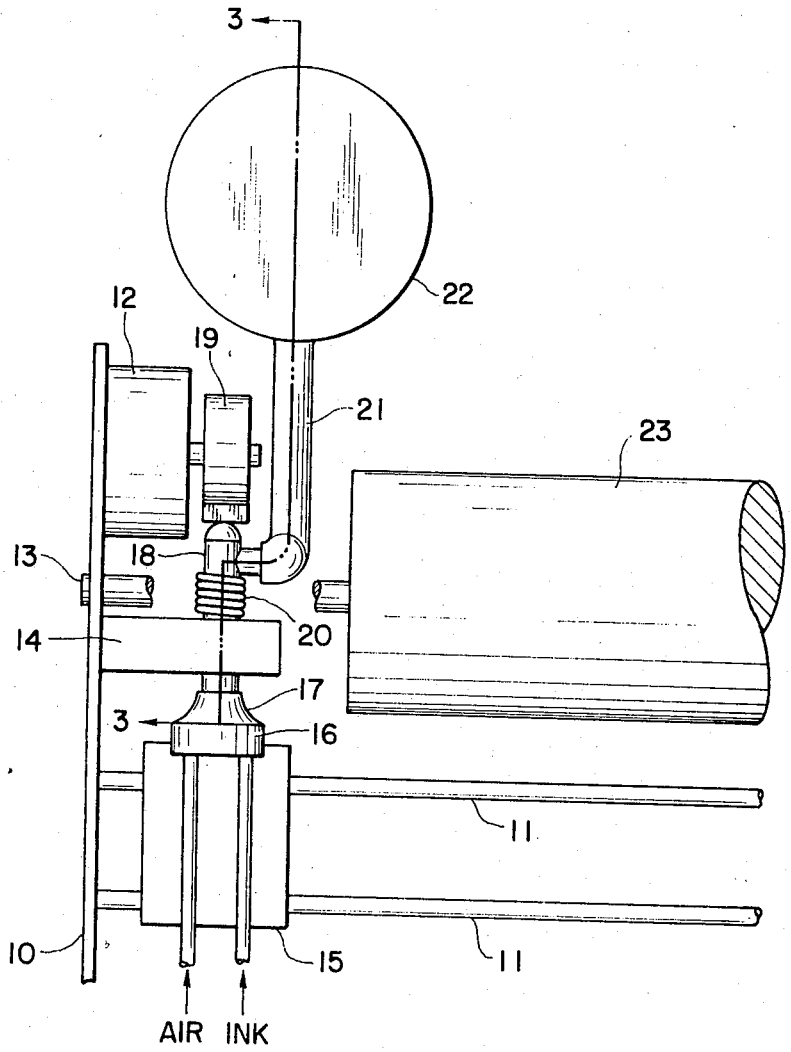
FIG. 1 is an illustration of a top plan view of the ink jet writing apparatus embodying the invention when the writing head is in non-printing position.

Referring now to FIG. 1, there is partially shown in a top plan view the ink jet writing apparatus in which the present invention is adapted for use. A support board 10 is provided to which a pair of guide rods 11, a pulse driven motor 12, a drum shaft 13, and a guide block 14 are mounted. On the guide rods 11 are slidably mounted a support member 15 which in turn carries an ink jet writing head 16 of the type described in the aforesaid U.S. Pat. No. 4,106,032. The writing head 16 is shown in non-printing position with its nozzle opening being enclosed by a cup-shaped enclosing member or lid 17 of an elastic material such as rubber or plastic. This enclosing member is attached to an end of a tube 18 which slidably supported by the guide block 14, the other end of the tube 18 coactively engaging the surface of a cam 19 mounted on the rotor shaft of the pulse driven motor 12. A compression spring 20 is provided on the tube 18 to urge it toward the cam 19. Adjacent to the closed end of the tube 18 is connected to a second tube 21 leading from a water supply source 22 from which water is fed to the enclosing member 17 in a manner as will be described. On the shaft 13 is mounted a drum 23 on the surface of which is rolled a sheet of recording paper. As is well known in the art, this drum is rotated by the width of line path along which ink jet is printed when the writing head 16 scans across the paper.

Figure 2:
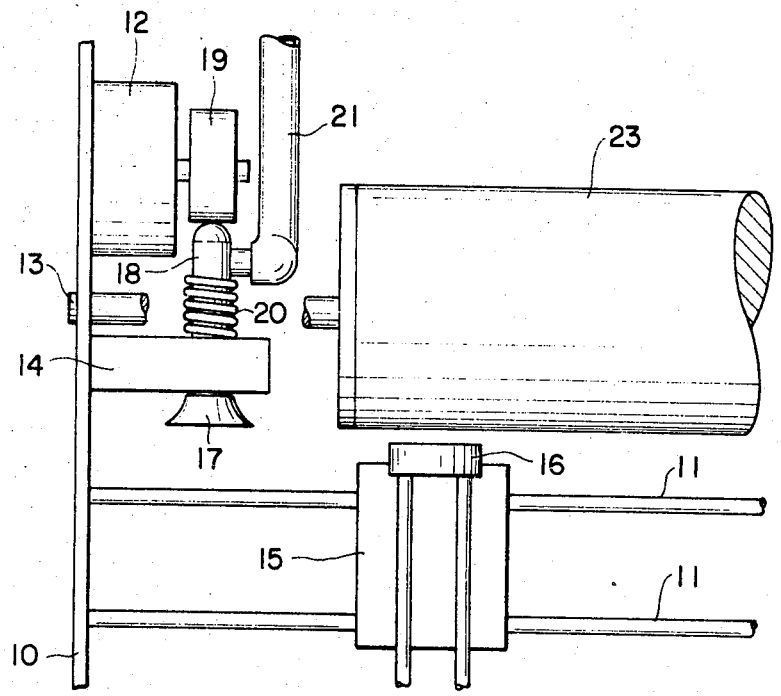
FIG. 2 is an illustration of the apparatus similar to FIG. 1 with the exception that the writing head is in a printing position.

When the apparatus is in operation, the motor 12 is energized briefly to rotate the cam 19 so that the tube 18 is moved to a retracted position by the action of the spring 20. At the same time the writing head 16 is caused to move to a printing position as illustrated in FIG. 2.

Figure 3:
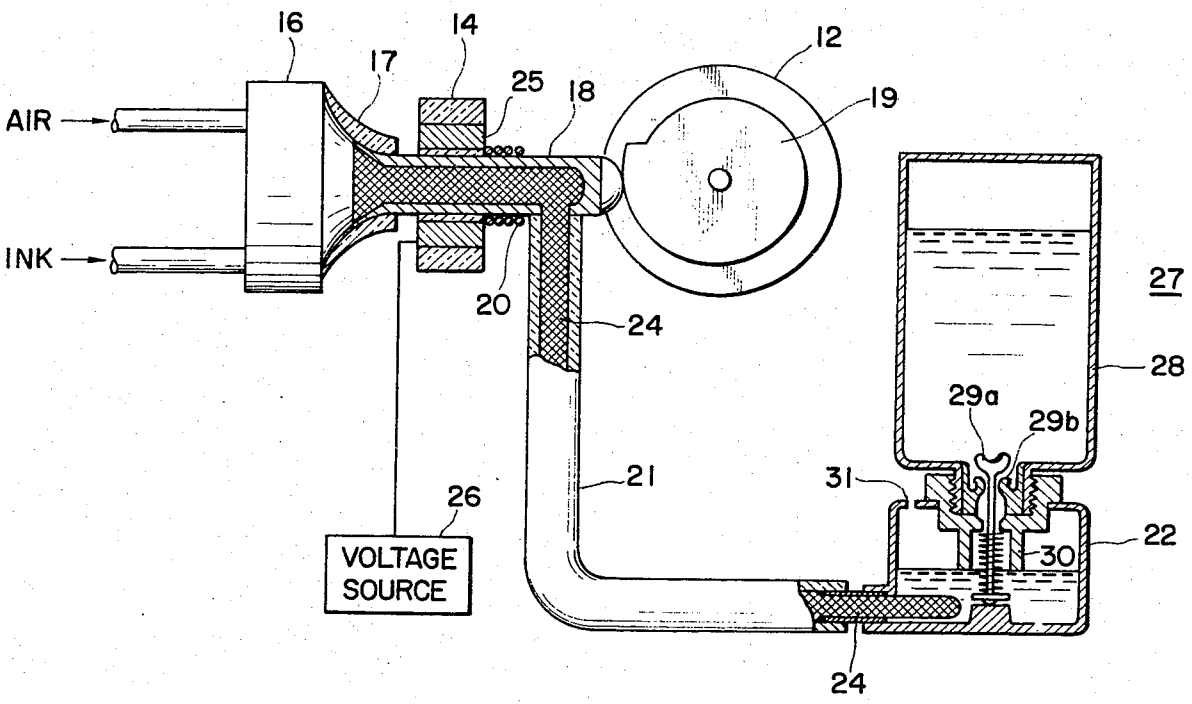
FIG. 3 is an illustration of a cross-sectional view taken along the line 3—3 of FIG. 1.

As illustrated in more detail in FIG. 3 which is a cross-sectional view of FIG. 1, the water supply source 22 is located in a position lower than the writing head 16. According to the invention, the tubes 18 and 21 are filled with a porous capillary member 24 such as glass fibers or a material having an open-cell cellular structure. The capillary member 24 extends partly into the water container 22 to absorb water and transmit it by capillary action to the opposite end which partly extends into the enclosure 17 and terminates into a fan-shaped configuration to enhance evaporation. To ensure a sealing contact between the front face of the writing head 16 and the front edge of the enclosure 17, the latter has a forwardly increasing diameter portion with forwardly decreasing thickness. Due to the flexibility of the material that forms the member 17, the front edge of the latter expands as it makes a pressure contact with the head 16 by the action of cam 19 creating a completely sealed chamber between these contacting members, whereby the evaporated water rapidly fills the chamber and the wet condition is maintained for a substantial period of time without the need for supply from the source 22.

To further assist evaporation of water the guide block 14 includes a heating element 25 in the shape of a ring surrounding the front end portion of the tube 18. This heating element is supplied with a current from a voltage source 26 when the system is in the standby position to raise the temperature of the water inside the tube 18.

Figure 4:
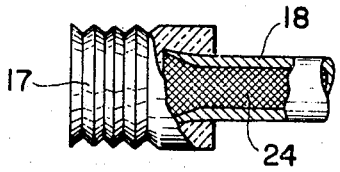
FIG. 4 is an illustration of an alternative embodiment of the elastic enclosing member of FIG. 3.

The enclosure 17 may also be in the form of a bellows as illustrated in FIG. 4 which obviously provides an intimate contact with the front face of the head 16 by a slight pressure acted upon the tube 18 by the cam 19.

Since the nozzle opening is completely shut off from the outside by the enclosure 17 when the apparatus is not in operation, the nozzle is also protection from dust or fine particles. When a dew point is reached in the confined moisture chamber, the rate of evaporation automatically decreases so that there is no possibility that the ink standing in the nozzle would be diluted excessively by the condensed water droplets.

For ease of maintenance the water supply source 22 is arranged to carry thereon a water cartridge 27 which comprises a container 28, a nozzle 30, a spring-biased valve member 29*a* and a valve seat 29*b*. The valve member 29*a* is normally seated on the valve seat 29*b* when the cartridge is detached from the container 22. When the cartridge is mounted on the container 22 as illustrated with its nozzle 30 projecting down into the container 22 through an opening thereof, the valve member 29*a* engages the bottom of the container 22, whereby the valve is disengaged from contact with the seat 29*b* to allow water to be admitted from the container 28 into the lower container 22 until the head of water therein becomes flush with the opening of the nozzle 30. When the water in the container 22 has been consumed reducing the water level from the nozzle opening, air is admitted through an opening 31 into the container 22 and thence into the upper container 28 in the form of bubbles, so that the water in the upper container 28 is admitted into the lower container to compensate for the amount of consumption. Therefore, the head of the water in the container 22 is maintained at a constant level at all times which is balanced against the atmospheric pressure, the rate of water feed to the enclosure 17 and hence the rate of evaporation is rendered constant regardless of the amount of water contained in the cartridge 27.

Figure 5:
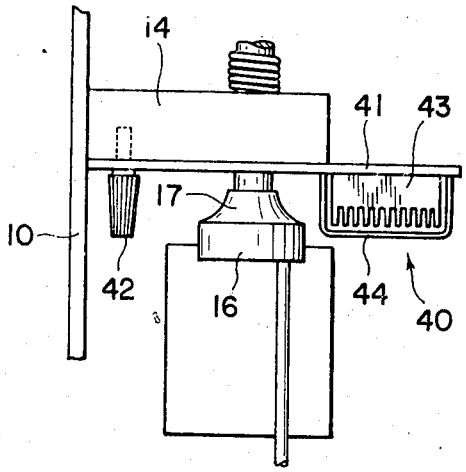
FIG. 5 is an illustation of the apparatus embodying a cleaning device.

FIG. 5 is an illustration of another embodiment of the invention. In this embodiment, a cleaning device 40 is mounted on a lateral side of the enclosing member 17 on a spring board 41 which in turn is detachably mounted on the guide block 14 by means of a screw 42. The cleaning device 40 comprises a serrated elastic wiping member 43 formed of rubber or high-polymer compound, and a collector 44 mounted below the wiping member 43 to collect scraped-off sludges. The front edges of the serrated flexible member 43 are so positioned that they are brought into a wiping contact with the front face of the writing head 16 as the latter is moved between non-printing and printing positions. This wiping action scrapes off a sludge produced by the absorption of water vapor by the dried mixture of ink and dust which has accumulated around the nozzle opening of the head 16 as a result of the spraying action of ink when expelled from the nozzle in response to an input signal of a near threshold level (which is a function of the physical properties of the ink) or as a result of the splashing action of the expelled ink as it strikes the surface of the recording paper.

The ink jet writing head of the above-mentioned United States Patents provides a means for ejecting a stream of air along the path of the issued ink droplets in order for the latter to be assisted in arriving the writing surface in a small, sharply defined area by the confining action of the air flow. This air flow is advantageously employed for purposes of preventing the sludge from introducing into the nozzle as it is scraped off by the cleaning member 43.

Figure 6:
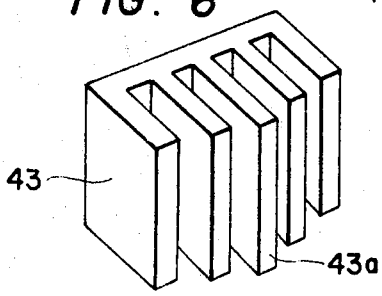
FIG. 6 is an illustration of an example of the cleaning device of FIG. 5.

The cleaning member 43 may take any one of various forms. One example is shown in FIG. 6. The exemplified cleaning member is formed with a plurality of serrated segments having increased lengths toward the center segment 43*a* to form a smooth wiping contact face against the front face of the head 16 as the latter is moved in opposite directions. For routine maintenance purposes, the screw 42 permits the maintenance personnel to detach the cleaning device 40 from the apparatus for flushing it with water, or replace it with a new one.

What is claimed is:

1. An ink jet writing apparatus comprising:

an ink jet writing head having a nozzle from which ink issues in use;

an elastic enclosure engageable with a front face of said writing head to define a fluid-tight chamber enclosing the opening of said nozzle;

a source of ink diluting fluid;

a conduit member connected between said fluid source and said elastic enclosure, said member including therein a capillary member for transmitting said fluid from said source to said enclosure by capillary action to permit evaporation of said fluid in said chamber; and means for producing sealing contact between said writing head and said enclosure to create said fluid-tight chamber when said writing head is not in use.

2. An ink jet writing apparatus as claimed in claim 1, wherein said elastic enclosure comprises a cup-shaped member of an elastic material having an increasing diameter toward said writing head.

3. An ink jet writing apparatus as claimed in claim 2, wherein said cup-shaped member has a decreasing thickness toward said writing head.

4. An ink jet writing apparatus as claimed in claim 1, wherein said elastic enclosure comprises a bellows.

5. An ink jet writing apparatus as claimed in any one of the preceding claims, wherein said capillary member comprises a bundle of glass fibers.

6. An ink jet writing apparatus as claimed in claim 1 or 2 or 3 or 4, wherein said capillary member comprises a porous material of open-cell cellular structure.

7. An ink jet writing apparatus as claimed in claim 1 or 2 or 3 or 4, further comprising means for heating a portion of said capillary member when said writing head is not in use.

8. An ink jet writing apparatus as claimed in claim 1 or 2 or 3 or 4, wherein said source of ink diluting fluid comprises means for maintaining the head of said diluting fluid constant.

9. An ink jet writing apparatus as claimed in claim 8, wherein said source of diluting fluid comprises a first container to which said conduit member is connected, and a second container detachably mounted on said first container, said second container comprising a nozzle formed with a valve seat and a spring-biased valve member normally seated on said valve seat under pressure when said second container is detachably from said first container, said nozzle of said second container extending partly into said first container, said valve member being arranged to engage the bottom of said first container to disengage from contact with said valve seat to allow fluid in said second container to be admitted into said first container until it reaches the opening of said nozzle of said second container, said first container including an opening through which air is introduced thereinto from the outside, whereby the fluid in the second container is admitted into said first container when the head of said fluid in said first container is lowered from the nozzle opening of said second container.

10. An ink jet writing apparatus as claimed in claim 1, 2, 3 or 4, wherein said writing head is movable between writing and non-writing positions, further comprising a scraper mounted adjacent said elastic enclosure in a position stationary with respect to the front surface of said writing head for making a resilient wiping contact with said front face when said writing head moves between said positions for scraping undesired material attached to said front face.

11. An ink jet writing apparatus as claimed in claim 10, wherein said scraper comprises an elastic member having a plurality of serrated segments.

12. An ink jet writing apparatus as claimed in claim 10, wherein said writing head further comprises means including a second nozzle aligned with the first-mentioned nozzle for providing a stream of air from the second nozzle when said writing head is not in use to prevent said undesired material from entering the path of said issued ink as said scraper is making a resilient wiping contact with said writing head.

* * * * *